US008911035B2

(12) United States Patent
Köpnick et al.

(10) Patent No.: US 8,911,035 B2
(45) Date of Patent: Dec. 16, 2014

(54) FITTING FOR A CORNER CUPBOARD AND A CORNER CUPBOARD

(75) Inventors: Andreas Köpnick, Alpirsbach (DE); Dieter Stange, Lossburg (DE); Thomas Ziegler, Jettingen (DE); Artur Hirtsiefer, Neunkirchen (DE); Heinz-Josef Henscheid, Ruppichteroth (DE); Bermd Rödder, Ruppichteroth (DE); Jürgen Schnell, Lohmar (DE); Klaus-Dieter Schmidt, Nümbrecht (DE)

(73) Assignee: Hetal-Werke Franz Hettich GmbH & Co. KG, Alpirsbach (DE)

( * ) Notice: Subject to any disclaimer, the term of this patent is extended or adjusted under 35 U.S.C. 154(b) by 51 days.

(21) Appl. No.: 13/021,263

(22) Filed: Feb. 4, 2011
(Under 37 CFR 1.47)

(65) Prior Publication Data

US 2012/0049708 A1 Mar. 1, 2012

(30) Foreign Application Priority Data

Feb. 5, 2010 (EP) ..... 10400006

(51) Int. Cl.
*A47B 81/00* (2006.01)

(52) U.S. Cl.
USPC ..... 312/238; 312/325; 312/321.5

(58) Field of Classification Search
USPC ..... 312/238, 305, 307, 325, 310, 311, 326, 312/329, 321.5; 108/137, 139, 149, 144.11, 108/147
See application file for complete search history.

(56) References Cited

U.S. PATENT DOCUMENTS

| | | | | |
|---|---|---|---|---|
| 4,917,446 | A * | 4/1990 | Mariani | 312/325 |
| 2006/0012273 | A1* | 1/2006 | Kreyenkamp | 312/238 |
| 2009/0072551 | A1* | 3/2009 | Hirtsiefer | 292/223 |
| 2010/0084952 | A1* | 4/2010 | Sagel | 312/238 |
| 2011/0193455 | A1* | 8/2011 | Kreyenkamp et al. | 312/238 |

FOREIGN PATENT DOCUMENTS

| | | |
|---|---|---|
| DE | 202004011200 | 1/2006 |
| DE | 102006035157 A1 * | 4/2007 |

(Continued)

*Primary Examiner* — Darnell Jayne
*Assistant Examiner* — Ryan A Doyle
(74) *Attorney, Agent, or Firm* — Hoffmann & Baron, LLP

(57) ABSTRACT

On a fitting for a corner cupboard (11), in particular a kitchen corner cupboard, comprising a cupboard body (12) and an internal space (21) accessible via a corner cupboard door (19), wherein at least one panel (22) is movably guided by means of the fitting (12) between an inner position and an outer position, in which the panel (22) at least partially extends beyond a level (23) of a door opening, said fitting (12) including at least one support arm for supporting the panel, which support arm can be mounted on the one hand so as to be pivotable about a stationary swivel pin (25) and can be mounted on the other hand on the associated panel (22) in a manner so as to be pivotable about a panel-fixed bearing axle (26), and control means for controlling the panel movement in a swivel plane between the inner and the outer positions, said control means having two control levers that can respectively be indisplaceably supported on the one hand so as to be rotatable about a stationary swivel pin (25, 29) and on the other hand so as to be rotatable relative to a panel-fixed bearing axle (26, 30), with said two stationary swivel pins (25, 29) being arranged next to each other or coinciding, and with said two control levers being connected to each other via a connecting link (36) receiving the panel-fixed bearing axles (26, 30) of the control levers, which connecting link (22) in its turn can be fixed to the panel (22), one of the two control levers at the same time forms the support arm and is formed in the shape of a combined control/support lever (27) which has a higher bending stiffness at a right angle to the swivel plane compared to the other control lever (28).

12 Claims, 15 Drawing Sheets

(56) References Cited

FOREIGN PATENT DOCUMENTS

| | | | | |
|---|---|---|---|---|
| EP | 1925237 | | 5/2008 | |
| EP | 1925238 | A1 * | 5/2008 | ..... A47B 49/00 |
| EP | 1925239 | A1 * | 5/2008 | ..... A47B 81/00 |
| EP | 2064971 | A1 * | 6/2009 | |
| EP | 2092850 | | 8/2009 | |
| EP | 2092850 | A1 * | 8/2009 | ..... A47B 81/00 |
| EP | 2191745 | A1 * | 6/2010 | ..... A47B 49/00 |

* cited by examiner

FITTING FOR A CORNER CUPBOARD AND A CORNER CUPBOARD

BACKGROUND OF THE INVENTION

The invention relates to a fitting for a corner cupboard, in particular a kitchen corner cupboard, comprising a cupboard body and an internal space accessible via a corner cupboard door, wherein at least one panel is movably guided by means of the fitting between an inner position and an outer position, in which the panel at least partially extends beyond a level of a door opening, said fitting including at least one support arm for supporting the panel, which support arm can be mounted on the one hand so as to be pivotable about a stationary swivel pin and can be mounted on the other hand on the associated panel so as to be pivotable about a panel-fixed bearing axle, and control means for controlling the panel movement in a swivel plane between the inner and the outer positions, said control means having two control levers that can respectively be indisplaceably supported on the one hand so as to be rotatable about a stationary swivel pin and on the other hand so as to be rotatable relative to a panel-fixed bearing axle, with the two stationary swivel pins being arranged adjacent to each other or coinciding, and with said two control levers being connected to each other via a connecting link receiving the fixed-panel bearing axle of the control levers, which connecting link in its turn can be fixed to the panel.

Such a fitting is known for example from EP 2 092 850 A1, where the panel is supported by a support arm that is fixedly supported so as to be pivotable and is displaced, on the panel side, relative to the bearing axle during the movement of the panel. Further, two control levers are provided which are each designed a flat iron bar and which are fixedly supported so as to be pivotable. The two panel-fixed bearing axles of the two control levers are connected to each other via a support arm which in turn is part of an anti-tip device extending in a cruciform manner on the bottom surface of the panel and is fixed there. Altogether, the fitting has three levers, two of which are control levers for controlling the panel movement between the inner and the outer positions, and a support arm used for supporting the panel. There is a functional separation between the panel support on the one hand, which is effected by the support arm, and the panel control on the other, which is realised by means of the two control levers.

From DE 20 2004 011 200 U1 a fitting is known wherein a respective panel is supported by two guide rods engaging on the bottom surface thereof in an articulated manner, the first guide rod being pivotable about a swivel pin of a support column and the second guide rod being pivotable about an axle of a support bearing that is parallel to the swivel pin of the support column. The panel is controlled by both guide rods together between the inner position and the outer position. The panel movement is effected here by a superposition of two circular path movements respectively carried out about the respective swivel pins. Ultimately, this will result in an S-shaped panel movement carried out between the inner position and the outer position of the panel.

SUMMARY OF THE INVENTION

It is the object of the invention to provide a fitting of the kind mentioned at the beginning, which needs as few fitting components as possible and which can at the same time be installed in the corner cupboard in a quick and simple manner.

This object is achieved by means of a fitting having the features of independent claim 1. Further developments of the invention are shown in the dependent claims.

The fitting according to the invention is characterised in that one of the two control levers at the same time forms the support arm and is formed in the shape of a combined control/support lever that has a higher bending stiffness at a right angle relative to the swivel plane compared to the other control lever.

This means that the fitting according to the invention only has a total of just two levers, of which the one formed as a control/support lever has the dual function of serving as a control lever for controlling the panel movement of the panel and as a support arm for supporting the panel. Thus, there is no functional separation as in the case of the fitting known from EP 2 092 850 A1.

Contrary to the fitting known from DE 20 2004 011 200 U1, where there is no functional separation between the support arm and the control lever either, the fitting according to the invention differs in that the stationary swivel pins of the control lever and of the control/support lever are located next to each other or coincide and that the two panel-fixed bearing axles of these levers are connected to each other via a connecting link.

In a further development of the invention, the control/support lever and the control lever are respectively formed as individual levers of constant lengths between their stationary and panel-fixed swivel pins and bearing axles.

In a particularly preferred manner, the control/support lever and the control lever are respectively supported with their stationary swivel pins on a support element which in turn can be fixed to a support column of the corner cupboard. Expediently, the support column stands freely, i.e. it is fixed in the corner cupboard without any contact with the lateral walls or with the front or rear side of the cupboard body. Since the two stationary swivel pins of the control/support lever and the control lever are preferably provided on the support element which in turn can be fixed to this support column, it results therefrom that none of the stationary swivel pins of the control/support lever and of the control lever is directly supported on the cupboard body.

In a further development of the invention, the control/support lever and the control lever have different lever lengths. For examples, the control/support lever can have a greater lever length than the control lever. By designing the levers with different lever lengths it is achieved that the panel-fixed support axles of these levers describe a circular path having different radii during the panel movement between the inner position and the outer position. Thus, the control/support lever and the control lever can therefore move relative to each other during the movement of the panel. Alternatively, of course, it is possible to force the panel-fixed support axles to move along circular paths with different radii by way of arranging the stationary swivel pins of these levers, with the levers having the same lengths, next to each other, but at a certain distance from each other.

The stationary swivel pins of the control/support lever is preferably located closer to a longitudinal axis of the support column than the stationary swivel pin of the control lever.

In a further development of the invention, the panel-fixed support axles received by the connecting link are located, in the condition in which the connecting link is fixed to the panel, on the same panel half with respect to a central transverse axis of the panel, which axis divides the panel into two panel halves.

In order to a achieve a relatively large bending stiffness at a right angle to the swivel pin of the control/support lever, so that this lever is able to support weight of the panel, the control/support lever is preferably formed from a metal tube, preferably a square metal tube. In principle, an embodiment with a circular metal tube would also be conceivable.

By contrast, the control lever is formed from a flat metal material, for example as a flat iron bar.

In a particularly preferred manner, the connecting link has an axle beam receiving the two panel-fixed bearing axles and a support arm which is rigidly connected to the axle beam and which supports the panel besides the control/support lever. Thus, if the two panel-fixed bearing axles are located on one panel half, then this support arm can then protrude into the other panel half, as a result of which a reliable support of the panel and protection against tipping are achieved.

Expediently, the support arm can include fastening means, via which it can then be fixed to the bottom surface of the panel as well as to the axle beam. Preferably, the support arm is also formed by a metal tube, in particular a square metal tube.

In a further development of the invention, the axle beam has a plate-like first axle journal and a plate-like second axle journal extending parallel thereto, which are kept spaced apart by at least one spacer and which receive between them the panel-fixed swivel pin of the control/support lever.

It is possible for the two panel-fixed bearing axles to be located on the axle beam on a connecting line extending at an obtuse angle relative to a longitudinal axis of the support arm.

The invention further comprises a corner cupboard having the features set forth in the claims.

The corner cupboard according to the invention is characterised in that one of the two control levers at the same time forms the support arm and is formed in the shape of a combined control/support lever which has a greater bending stiffness at a right angle relative to the pivot plane compared to the other control lever. Preferred embodiment examples of the invention are illustrated in the drawings and will be explained in more detail below, wherein:

DETAILED DESCRIPTION FOR THE PREFERRED EMBODIMENTS

Figure 1:
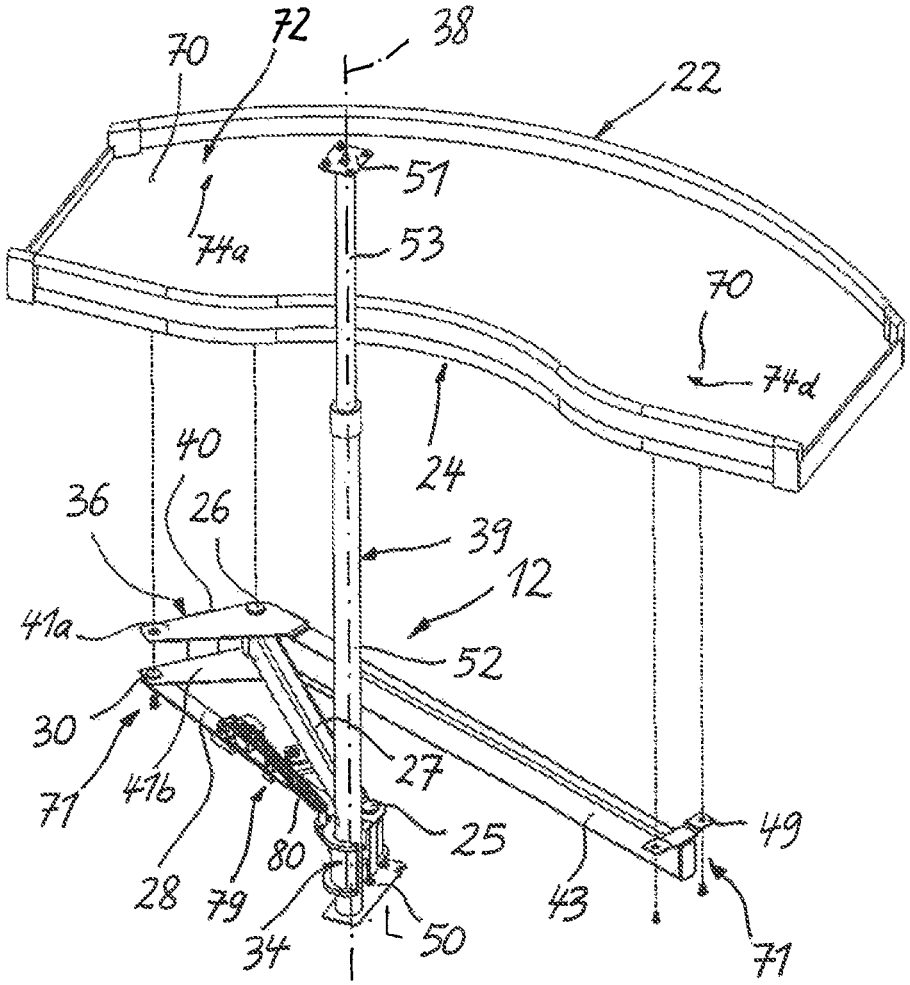
FIG. 1 shows a perspective view of a first embodiment example of the fitting according to the invention, which is fixed to a support column and is provided for fixing to a panel via fastening interfaces.
Figure 2:
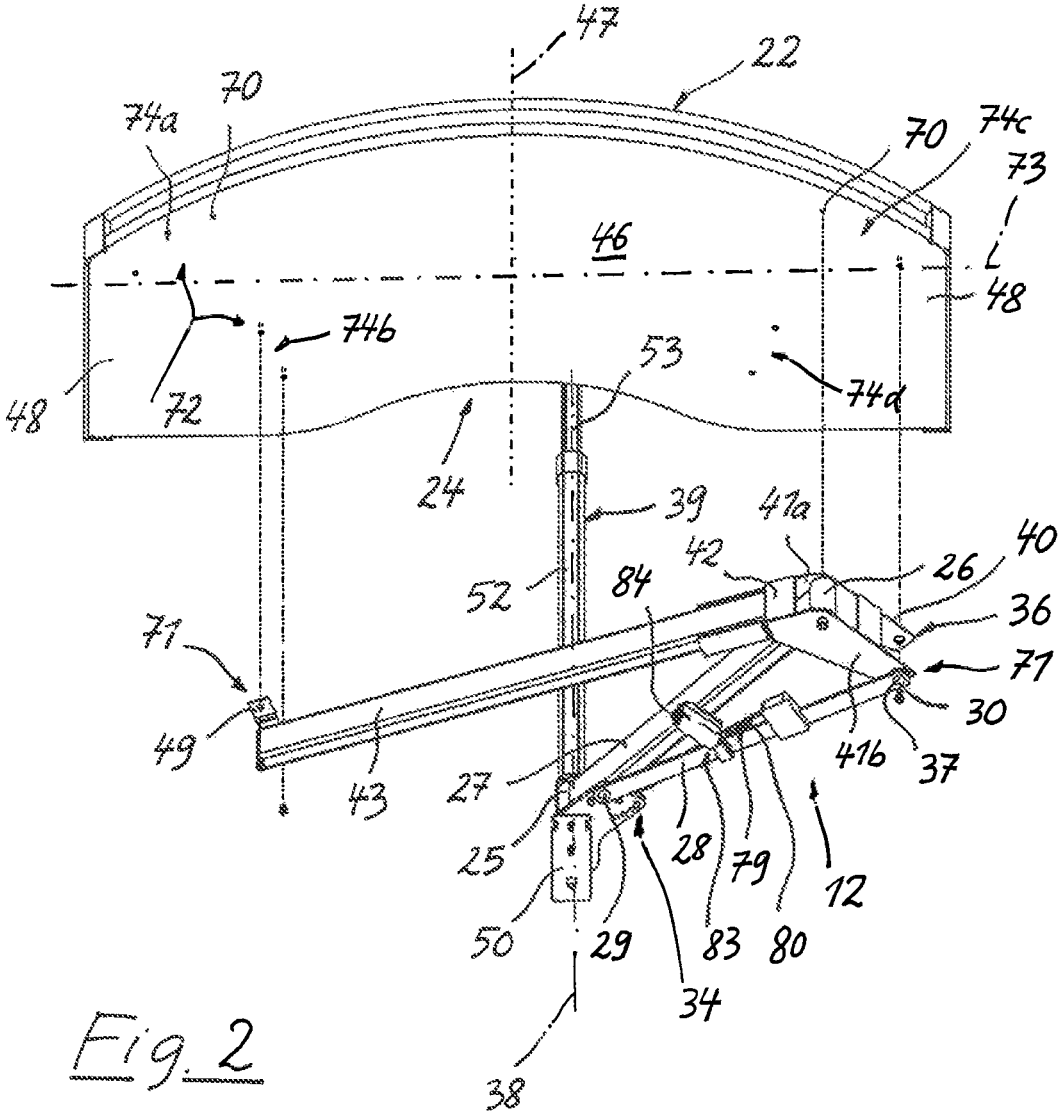
FIG. 2 shows a perspective view of the fitting of FIG. 1 from the bottom with the fastening interfaces on the panel bottom surface of the panel.
Figure 3:
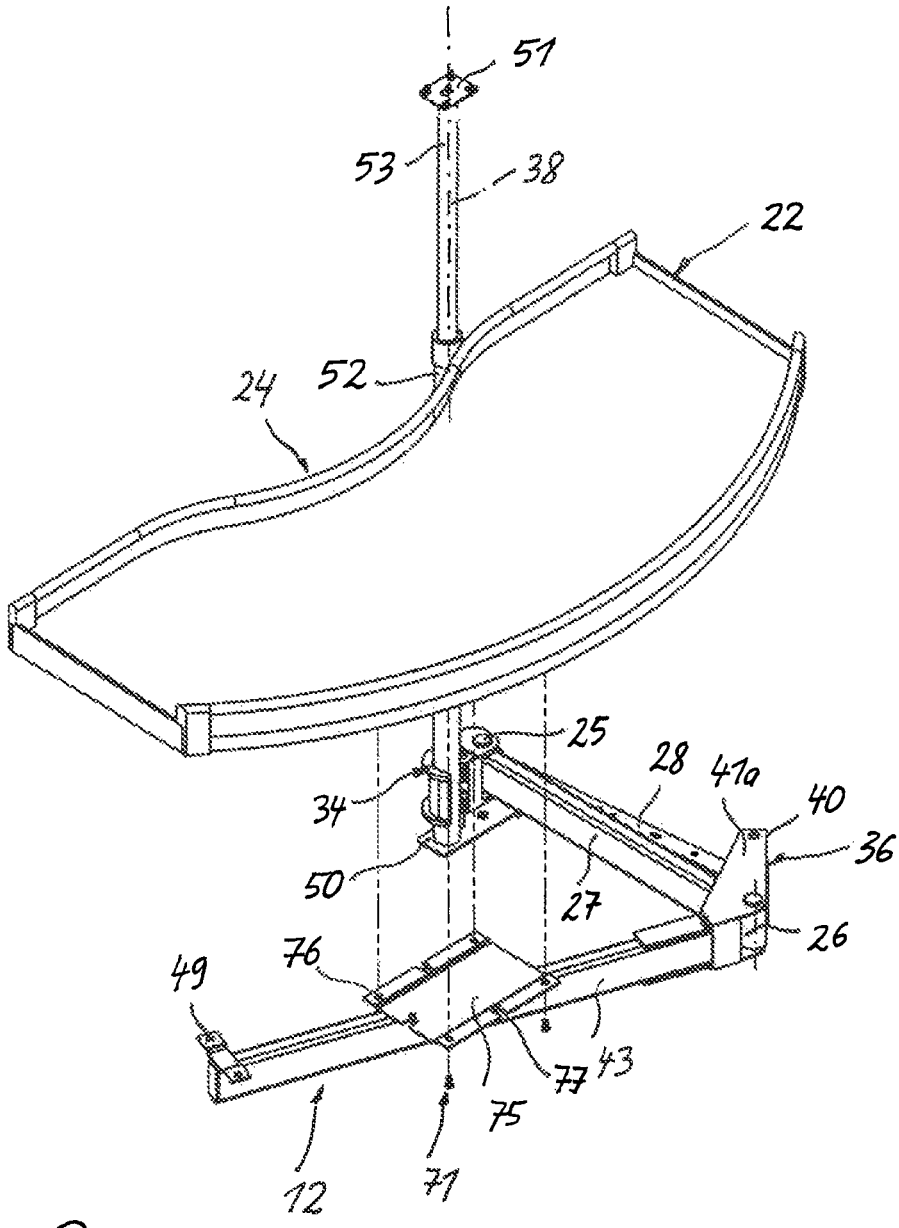
FIG. 3 shows a perspective view of a second embodiment examples of the fitting according to the invention, which is fixed to a support column and is provided for fixing to a panel via fastening interfaces.

FIGS. 1 and 2 respectively show a first embodiment example of the corner cupboard 11 according to the invention and the fitting 12 according to the invention that is installed therein. As can be seen in particular in FIGS. 8 to 12 as well as 21 to 23, the corner cupboard 11 comprises a cupboard body 13 which is illustrated by way of example with a rectangular layout. The cupboard body 13 for its part is made up from a rear wall 14, two lateral walls 15, 16 and a front side, which in turn is divided into a front wall 18 and a corner cupboard door 19 that is positioned adjacent thereto. As can be seen especially in the top views of FIGS. 21 to 23, the corner cupboard door 19 is positioned, if viewed from the front, on the right-hand side of the front side 17 and the front wall 18 correspondingly on the left-hand side of the front side 17. This means that the outward movement of the panel is carried out in a clockwise direction. As will be explained in more detail below, the corner cupboard door 19 may alternatively also be positioned on the left-hand side of the front side 17 of the corner cupboard 11, so that the outward movement of the panel is carried out from the inner position by swinging out in a counter-clockwise direction.

Further, a cupboard bottom 20 is also provided. The front wall 18 and the corner cupboard door 19 occupy approximately the same proportions of the front side 17. The rectangular cupboard body 13 delimits a correspondingly rectangular internal space 21 which is accessible approximately at the centre via the corner cupboard door 19.

In the internal space of the corner cupboard 11, at least one panel 22 is provided, which is movably controlled in a swivel plane by means of the fitting 12 between an inner position, in which the panel 22 is completely accommodated in the internal space 21, and an outer position, in which the panel 22 extends at least partially beyond a level 23 of a door opening of the corner cupboard 11. A single panel 22 is shown here by way of example. Alternatively it is possible to arrange two or more panels 22 above one another in the corner cupboard 11. Further, the panel 22 is shown by way of example in a one-piece embodiment. However, it is also possible to use multi-piece panels 22.

Also the layout of the panel 22 is shown by way of an example in the shape of a kidney. The panel 22 has a cutout 24 on the inside thereof that faces the front wall, in order to enable effortless swinging out from the internal space 21 or swinging in into the internal space 21, without the panel 22 hitting against or catching on the front wall 18.

The fitting 12 has at least one support arm for supporting the panel, which support arm is mounted on the one hand, in the installed condition of the panel 22, so as to be pivotable about a stationary swivel pin 25 and which is on the other hand mounted on the associated panel so as to be pivotable on a panel-fixed bearing axle 26, and control means for controlling the panel movement in the swivel plane between the inner position and the outer position.

The control means further include two control levers, one of which forms at the same time the support arm and is formed in the shape of a combined control/support lever 27, which has a greater bending stiffness at a right angle relative to the swivel plane compared to the other control lever 28. This means that the control/support lever serves the dual function of controlling, as the control lever, the panel movement between the inner position and the outer position and of supporting, as the support arm, the panel 22. The control lever 28 is also indisplaceably supported on the one hand so as to be pivotable about a stationary swivel pin 29 and on the other hand so as to be pivotable in relation to a panel-fixed bearing axle 30. The control/support lever 27, too, is indisplaceably supported so as to be rotatable about its panel-fixed bearing axle 26. The two stationary swivel pins 25, 29 of the control/support lever 27 and of the control lever 28 are arranged next to each other or coincide; the depicted embodiment examples show by way of example an adjacent arrangement of the stationary swivel pins 25, 29.

Figure 14:
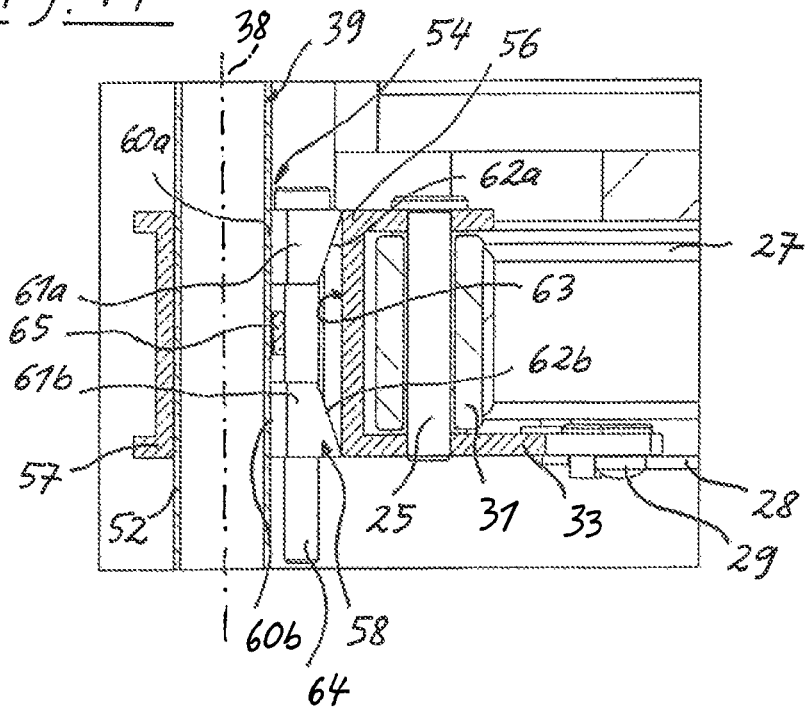
FIG. 14 shows a longitudinal section through the support column and the clamping piece along the line XIV-XIV in FIG. 13.

In order to achieve a sufficiently great bending stiffness of the control/support lever 27 so as to enable it to fulfill its function as a support arm for supporting the panel, said lever is formed from a square metal tube. As shown in particular in FIG. 14, a bearing bushing is fixed, particularly welded, to the stationary end of the square tube. A bearing pin, for example in the form of a rivet, is inserted through this bearing bushing 31, which bearing pin is in turn fixed with a U-shaped bearing portion 33 receiving the bearing bushing 31 to a clamping piece 34 to be described in more detail below. The bearing pin forms the stationary swivel pin 25, about which the control/support lever 27 is supported so as to be pivotable. At the opposite end of the control/support lever 27 formed as a square tube, a further bearing bushing 35 is mounted, particularly welded, in a similar way. A bearing pin passes through the bearing bushing 35, which bearing pin is in turn supported on a connecting link 36 to be described in more detail below. This means that the bearing pin forms the panel-fixed bearing axle 26 of the control/support lever 27.

Unlike the control/support lever 27, the control lever 28 is formed by a flat iron bar. As is shown particularly in FIG. 2 and in FIG. 14, the control lever 28 has on both opposite ends respectively one especially circular through opening 37, through each of which a bearing pin, for example in the form of a rivet, is inserted. One end of the control lever 28 is in turn supported on the clamping piece 34, with the bearing pin forming the stationary swivel pin 29 of the control lever 28. The opposite end is supported by the other bearing pin on the connecting link 36, said bearing pin forming the panel-fixed bearing axle 30 of the control lever 28.

This means that both stationary swivel pins 25, 29 of the control/support lever 27 and of the control lever 28 are disposed on the clamping piece 34, whilst according to the described embodiment examples, the stationary swivel pins 25 of the control/support lever 27 is supported closer to a longitudinal axis 38 of a support column 39, which will be described in more detail below, than the stationary swivel pin 29 of the control lever 28. Further, the lever length of the control/support lever 27 is greater than the lever length of the control lever 28, so that the panel-fixed bearing axle 26 of the control/support lever 27 describes a circular arc with a greater radius than the panel-fixed bearing axle 30 of the control lever 28. This leads to a relative movement of the control/support lever 27 and the control lever 28 during the panel movement between the inner position and the outer position.

As mentioned above, the two panel-fixed bearing axles 26, 30 of the control/support lever 27 and of the control lever 28 are located on a connecting link 36 which therefore connects these two panel-fixed bearing axles 26, 30 to each other. To this end, the connecting link 36 has an axle beam 40, on which the two panel-fixed bearing axles 26, 30 are supported in the manner described above.

The axle beam 40 is formed in the manner of a yoke and has a plate-like first axle journal 41*a* and a plate-like second axle journal 41*b* extending parallel thereto, which are spaced apart by two spacers 42 in the form of material webs. Between the two axle journals 41*a*, 41*b*, the bearing bushing 31 which is attached to one end of the control/support lever 27. By contrast, the control lever 28 is supported only on one of the two axle journals 41*a*, 41*b* by means of the bearing pin forming the panel-fixed bearing pivot 30.

Figure 8:
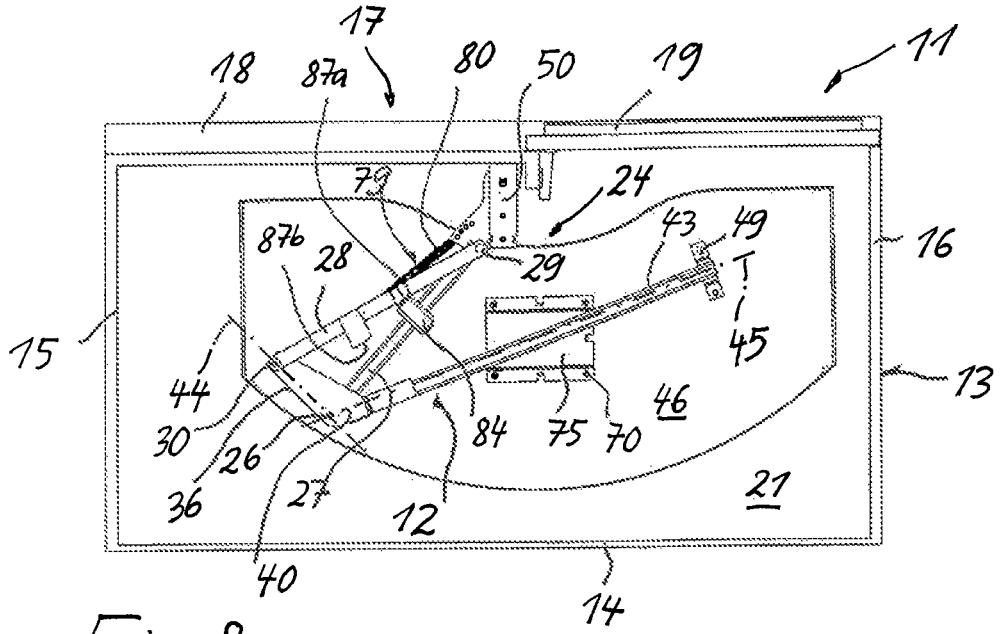
FIG. 8 shows a bottom view of the second embodiment example of the fitting according to the invention according to FIG. 3 in the condition, in which it is installed in the corner cupboard, with the panel being in its inner position.

Apart from the axle beam 40, the connecting link 36 also has an elongate support arm 43, which is also implemented as a square tube. The support arm 43 and the axle beam 40 are rigidly connected to each other, they may for example be welded to each other. Here, the panel-fixed bearing axles 26, 30 on the axle beam 40 have a connecting line 44 which extends at an obtuse angle relative to a longitudinal axis 45 of the support arm 43 (FIG. 8). In the fixed condition of the fitting 12 on the panel bottom surface 46 of the panel 22, the axle beam 40 is located with the two panel-fixed bearing axles 26, 30 in the one panel half formed by the central transverse axis 47, whilst the support arm 43 protrudes into the other one of the two panel halves 48.

The support arm 43 has a support function besides the control/support lever 27 for supporting the panel 22. It ensures that the panel 22 is not just supported on one panel half 48, which could cause instabilities, particularly if any items are standing on the panel. In this case, a large momentum would be applied to the fastening point between the axle beam 40 and the panel, which could cause the axle beam 40 to be separated from the panel 22.

On the support arm 43, at least one mounting lug 49 is provided, via which the support arm 43 can be fixed to the panel bottom surface 46 of the panel. Expediently, the mounting lug 49 is located on that end of the support arm that is opposite the axle beam 40.

The corner cupboard 22 further has the support column 39 with a longitudinal axis 38, as was mentioned previously. The support column 39 is mounted to the cupboard bottom 20 via a bearing plate 50 and stands freely in the cupboard body 13, which means it is not connected to the lateral walls 15, 16 or with the front wall 18 or the rear wall 14. At the end of the support column 39, that is opposite the cupboard bottom 20, a further bearing plate 51 is attached, via which the support column 39 is supported on a cupboard cover (not shown). The support column 39 is implemented as a telescopic column and has to this end a column base 52 and a telescopic portion 53 that is linearly displaceable within the column base 52. The telescopic ability of the support column 39 allows the latter to be adapted to different corner cupboard heights.

The fitting 12 is fixed to the support column 39 by means of a mounting device. The mounting device includes the aforementioned clamping piece 34 or bearing element, which has clamping means that can be adjusted between a clamping position 54 in which the fitting 12 is indisplaceably clamped to the support column 39 in a desired height relative to the support column 39 and a release position 55 allowing a continuous height adjustment of the fitting along the support column 39.

The clamping piece 34 is part of the fitting 12. It has a base body 56 and two clamping jaws 57, 58 which are movable relative to each other and which allow the associated support column 39 to be at least partially encompassed. On the base body 56, the U-shaped bearing portion 33 is located which receives the bearing bushing 31 of the control/support lever 27 and by means of which the bearing pin forming the stationary swivel pin 25 is supported in a pivotable manner. One of the legs of the bearing portion 33 is designed to be plate-like and has the through opening 37, on which the control lever 28 is supported in a pivotable manner by the bearing pin forming the stationary swivel pin 29. It is possible that this plate-like leg has several such through openings, so that the stationary swivel pin 29 can be relocated, as a result of which the swivel radius of the control lever 28 and the position thereof in relation to the control/support lever 27 can be changed.

As shown in particular in FIGS. 13 to 20, one of the two clamping jaws 57 is rigidly, i.e. immovably mounted on the base body 56.

Figure 15:
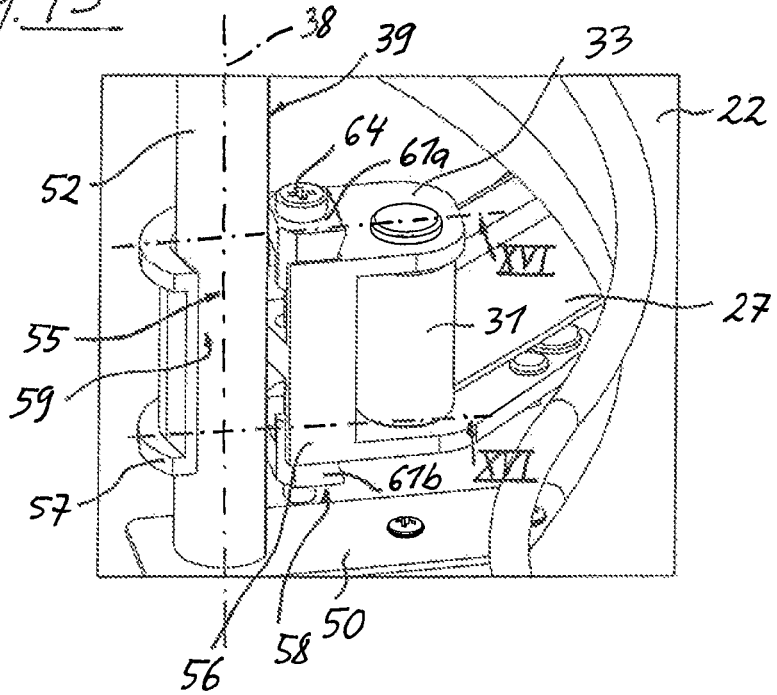
FIG. 15 shows an enlarged view of detail X in FIG. 11, with the clamping piece shown in a released position.
Figure 16:
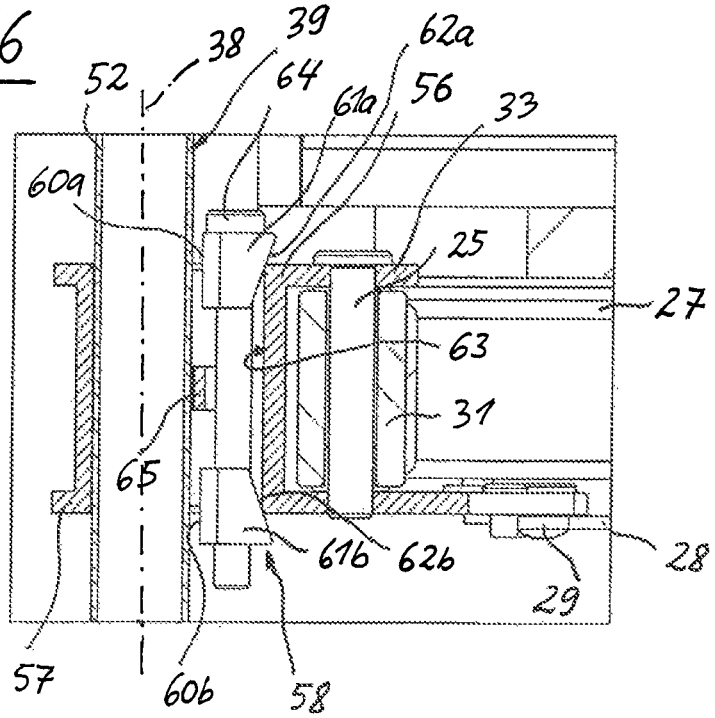
FIG. 16 shows a longitudinal section through the support column and the clamping piece along the line XVI-XVI in FIG. 15.
Figure 17:
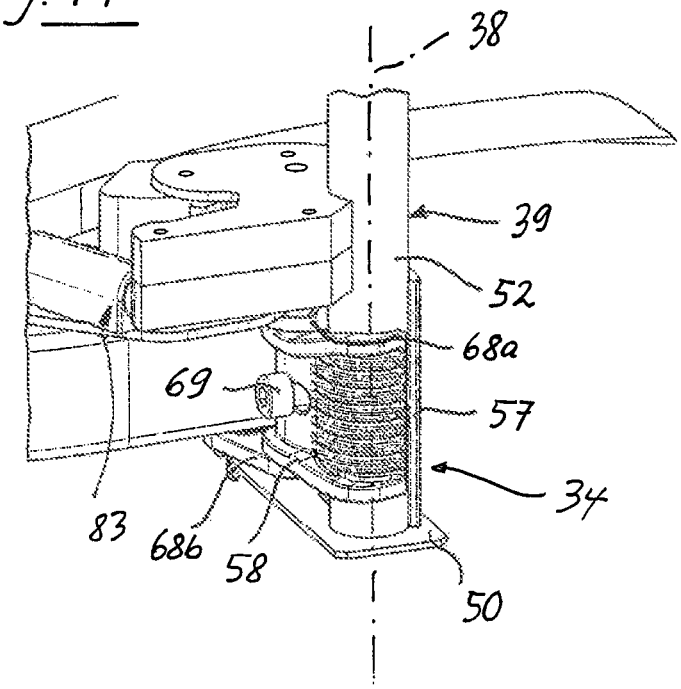
FIG. 17 shows a perspective view of an alternative embodiment of the clamping piece, with the clamping piece being in the clamping position.
Figure 18:
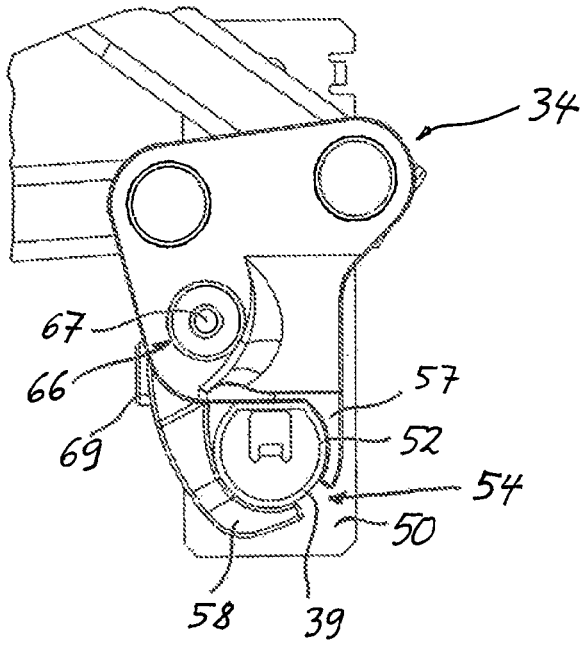
FIG. 18 shows a top view of the clamping piece of FIG. 17 with a cross section through the support column.

FIGS. 13 to 16 show a first embodiment of the clamping piece 34, according to which the rigid clamping jaw 57 is designed to be hook-like. The second clamping jaw 58 is arranged to be movable relative to the rigid clamping jaw 57, with the two clamping jaws defining an insertion opening 59 in the release position 55 as shown in FIGS. 15 and 16, respectively, by which opening the clamping piece 34 can be laterally attached to the support column 39, so that the two clamping jaws 57, 58 partially encompass the circumference of the support column 39. In the clamping position 54 shown in FIGS. 13 and 14, this insertion opening 59 is constricted to such a degree that the clamping piece 34 can no longer be removed at an angle relative to the longitudinal axis 38 of the support column 39 and moreover the clamping piece 54 has been clamped to the support column 39, so that said clamping piece is indisplaceably fixed relative to the support column 39. The clamping on of the clamping piece 34 is expediently carried out on the column base 52 of the support column 39.

According to the first embodiment, the movable second clamping jaw 58 is supported to be linearly displaceable by means of guiding means in the axial direction to the longitudinal axis 38 of the support column 39, whilst at the same time a clamping surface of the clamping jaw 58, which is oriented in the axial direction, may be displaced in the radial direction inwards in the direction of the rigid first clamping jaw. According to the first embodiment, the movable clamping jaw 58 has two jaw members 61*a*, 61*b* which are supported on the base body 56 of the clamping piece 34 so as to be movable in the axial direction relative to the longitudinal axis 38 of the support column relative to each other by means of actuators, whilst in the case of a movement towards each other, the clamping faces will be displaced radially inwards on the jaw members 61*a*, 61*b*. In order to achieve this, guide slopes 62*a*, 62*b*, which are part of the guiding means, are formed on the jaw members 61*a*, 61*b* at the end opposite the clamping surfaces 60*a*, 60*b*. As shown in particular in FIGS. 14 and 16, the guide slopes 62*a*, 62*b* cooperate with a slide-off surface 63 that is formed by a wall on the base body 56, which is oriented substantially parallel to the longitudinal axis of the support column 39. The guide slopes 62*a*, 62*b* of the jaw members 61*a*, 61*b* are inclined towards each other, i.e. in the case of a movement of the jaw members 61*a*, 61*b* towards each other, a constantly increasing cross section of the jaw members 61*a*, 61*b* slides off from the slide-off surface 63, as a result of which the clamping surfaces 60*a*, 60*b* are moved radially inwards towards the first clamping jaw 57. In order to initiate the relative movement between the two jaw members 61*a*, 61*b*, actuators in the form of an actuating screw 64 passing through the two jaw members 61*a*, 61*b* are used. As shown in particular in FIG. 15, the actuating screw 64 is additionally supported in a bearing stem 65 of the base body 65.

In order to fix the clamping piece 34 in the desired height position on the support column 39, the two clamping jaws 57, 58 are initially brought into the release position 55, with the two jaw members 61*a*, 61*b* being moved away from each other. This may be carried out by unscrewing the actuating screw 34. This creates an insertion opening 59, the cross section of which is larger than the cross section of the support column 39, so that the clamping piece 34 can be laterally attached to the support column 39. Once attached, the actuating screw 64 is screwed back in again, so that the two jaw members 61*a*, 61*b* are moved towards each other. Since each of the jaw members with their guide slopes 62*a*, 62*b* slides off from the slide-off surface 63, the clamping surfaces 60*a*, 60*b* of the jaw members 61*a*, 61*b* are moved in the direction of the outside of the support column 39, until they push against the support column 39 with a clamping force that is sufficient to clamp the clamping piece 34 against the support column 39.

FIGS. 17 to 20 show a second embodiment of the clamping piece 34. Here, a rigid, stationary first clamping jaw 57 and a second clamping jaw 58 which is movable relative thereto are provided. As shown in particular in FIG. 17, the rigid clamping jaw 57 has a jaw height that is greater than that of the movable clamping jaw 58. The movable second clamping jaw 58 is supported on the base body 56 of the clamping piece 34 so as to be pivotable by pivoting means 66 about a jaw pivot pin 67. The pivoting means are embodied in a way similar to the pivotal mounting of the control/support lever 27 or of the control lever 28. To this end the pivotal clamping jaw 58 is supported in a U-shaped bearing seat, with a pivot bearing pin passed through both bearing shanks 68*a*, 68*b* delimiting the bearing seat and through the clamping jaw 58. Here, the pivot bearing pin forms the jaw pivot axis 67. In order to lock the movable clamping jaw 58, locking means in the form of a locking screw are provided, which is preferably oriented in the transverse direction relative to the jaw pivot axis 67 and extends through both clamping jaws 58 and is supported on the rigid clamping jaw 58.

Figure 19:
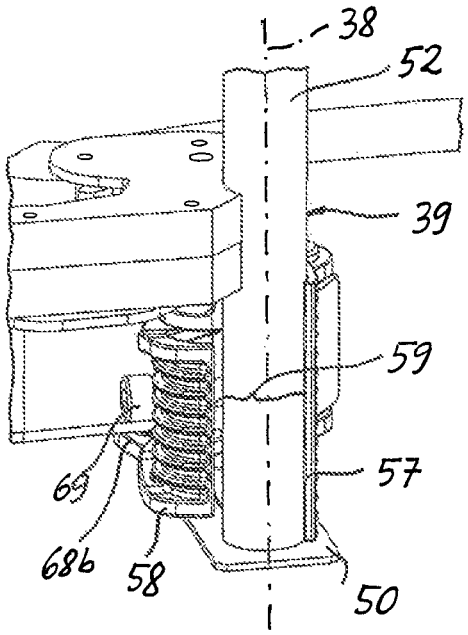
FIG. 19 shows a perspective view of the clamping piece of FIG. 17, said clamping piece being in the released position.
Figure 20:
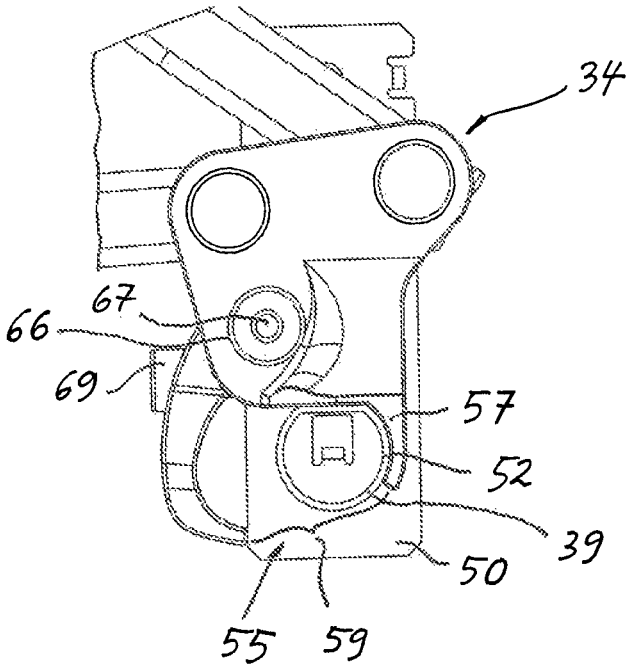
FIG. 20 shows a top view of the clamping piece of FIG. 19, with a cross section through the support column.

In order to fix the clamping piece 34 according to the second embodiment on the support column 39, the two clamping jaws 57, 58 are first brought into the release position 55 by unscrewing the locking screw 69. As a result, an insertion opening 59 as shown in FIG. 19 or 20 is obtained, the cross section of which is larger than the cross section or diameter of the support column 39, so that the clamping piece 34 can be laterally attached to the support column. Once the desired height position of the clamping piece 34 on the support column 39 has been reached, the locking screw 69 is screwed back in, so that the pivotal clamping jaw 58 is pivoted towards the rigid clamping jaw 57, until it ultimately pushes with a clamping force against the outside of the support column 39, so that the clamping piece is clamped onto the support column 39.

Since no components or modules are needed on the side of the support column 39 for fixing the clamping piece 34, the clamping pieces 34 can be clamped with infinite height adjustability at any desired position along the support column, in principle even on the telescopic portion 53.

As shown in particular in FIGS. 1 to 7, the fitting 12 is to be fixed to the panel bottom surface 46 of the panel 22. To this end, fastening interfaces 70 are formed on the panel bottom surface 46, which are used for fixing the fitting 12 by means of the fitting-side interface means 71 corresponding to the fastening interfaces 70.

Here, several fastening interfaces 70 form an interface pattern 72 that is designed in such a way that the fitting 12 can be fixed to the panel 22 in two different fastening positions, so that it can be swung depending on the specified fixing position either in a clockwise direction or alternatively in a counter-clockwise direction from the inner position to the outer position. The fastening interfaces 70 are designed as fixing holes, in which interface means in the form of fastening elements, for example bolts, rivets or the like, which are first passed through corresponding through holes in the fitting 12, can be fixed.

According to the first embodiment example shown in FIGS. 1 and 2 of the fitting 12 according to the invention, the interface means 71 are formed by the mounting lug 49 attached to the support arm 43, which lug has two through holes for passing fastening elements in the form of fixing screws therethrough, which in turn are fixed in the corresponding fastening interfaces 70 on the panel bottom surface 46. Further, the interface means 71 also include the bearing pin which constitutes the panel-fixed bearing axle 26 of the control/support lever 27. The latter protrudes through the two axle journals 41*a*, 41*b* of the axle beam 40 and protrudes upwards, so that it can be fixed in the corresponding fastening interface 70. Finally, the interface means 71 further include the bearing pin constituting the panel-fixed bearing axle 30 of the control lever 28. This bearing pin is passed through a through opening formed in both of the axle journals 41*a*, 41*b* and protrudes upwards from the top surface of the axle beam 40, so that it can be inserted into its corresponding fastening interface 70 on the panel bottom surface 46 and can be fixed there.

As shown in particular in FIG. 2, the interface pattern 72 according to the first embodiment example is spread over a large area of the panel bottom surface 46. Here, one half of the fastening interfaces 70 of this interface pattern is located in one panel half 48, whilst the other half is located in the other panel half. If a central longitudinal axis 73 is defined in addition to the central transverse axis 47, with the central longitudinal axis to be identified as the X axis and the central transverse axis as the Y axis, the panel 22 will be subdivided into four quadrants, with the fastening interfaces of the interface pattern 72 then being arranged so that they are spread over all four quadrants. According to the first embodiment example shown, four different interface groups 74*a*, 74*b*, 74*c*, 74*d* each having two fastening interfaces 70 are provided here. In order to fasten the fitting 12 to the panel bottom surface 46, however, only two of the four interface groups 74*a-d* are needed, so that the two other interface groups 74*a-d* remain unused. The interface groups 74*a-d* are here located, by way of example, in a mirror symmetrical fashion relative to the Y axis. Two of the interface groups 74*a*, 74*c* are located in the area of the rear edge of the panel, with the two fastening interfaces 70 of these interface groups 74*a*, 74*c* being arranged one behind the other in the X direction. The two other interface groups 74*b*, 74*d* are located approximately halfway up between the outer lateral edge of the panel 22 and the Y axis, with the fastening interfaces 70 of these interface groups 74*b*, 74*d* being arranged one behind the other in the Y direction.

Figure 21:
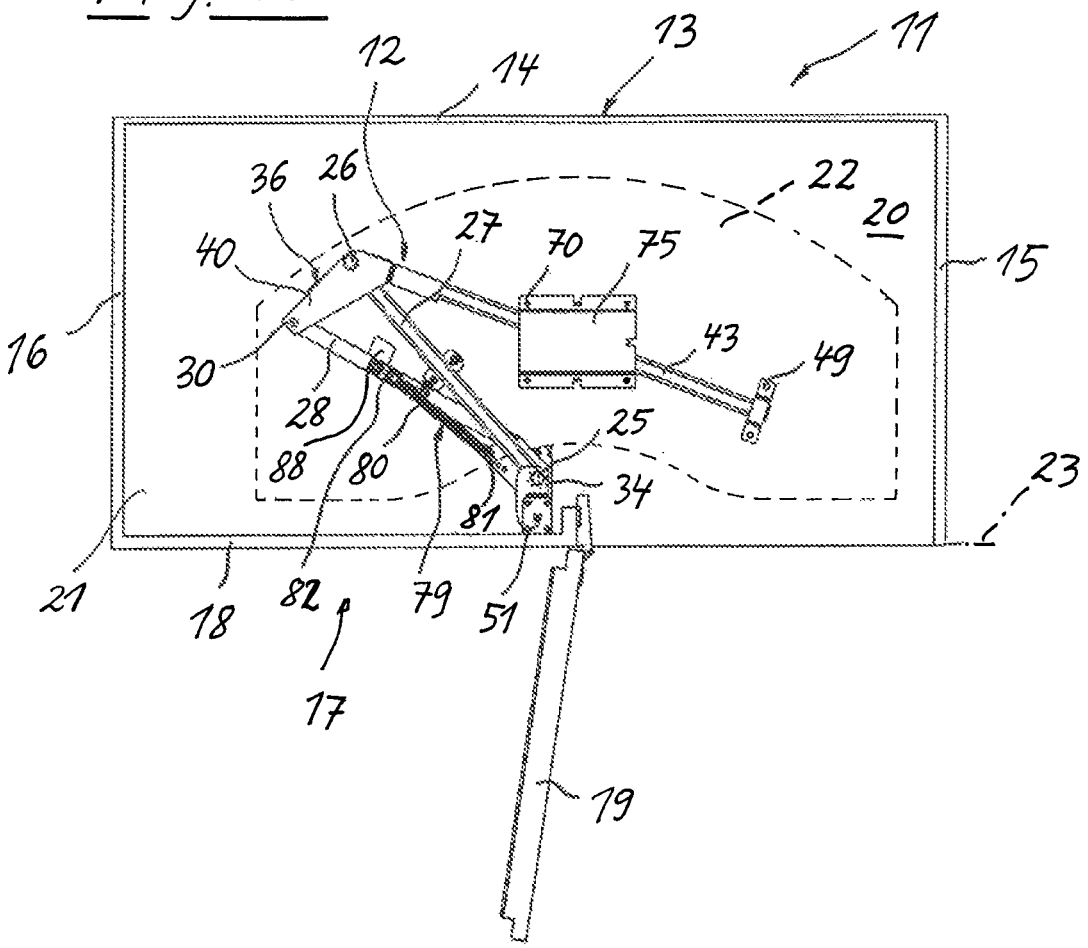
FIG. 21 shows a top view of the second embodiment example of the fitting according to FIG. 3 in a condition, in which it is installed in the corner cupboard, with the panel being in its inner position.
Figure 22:
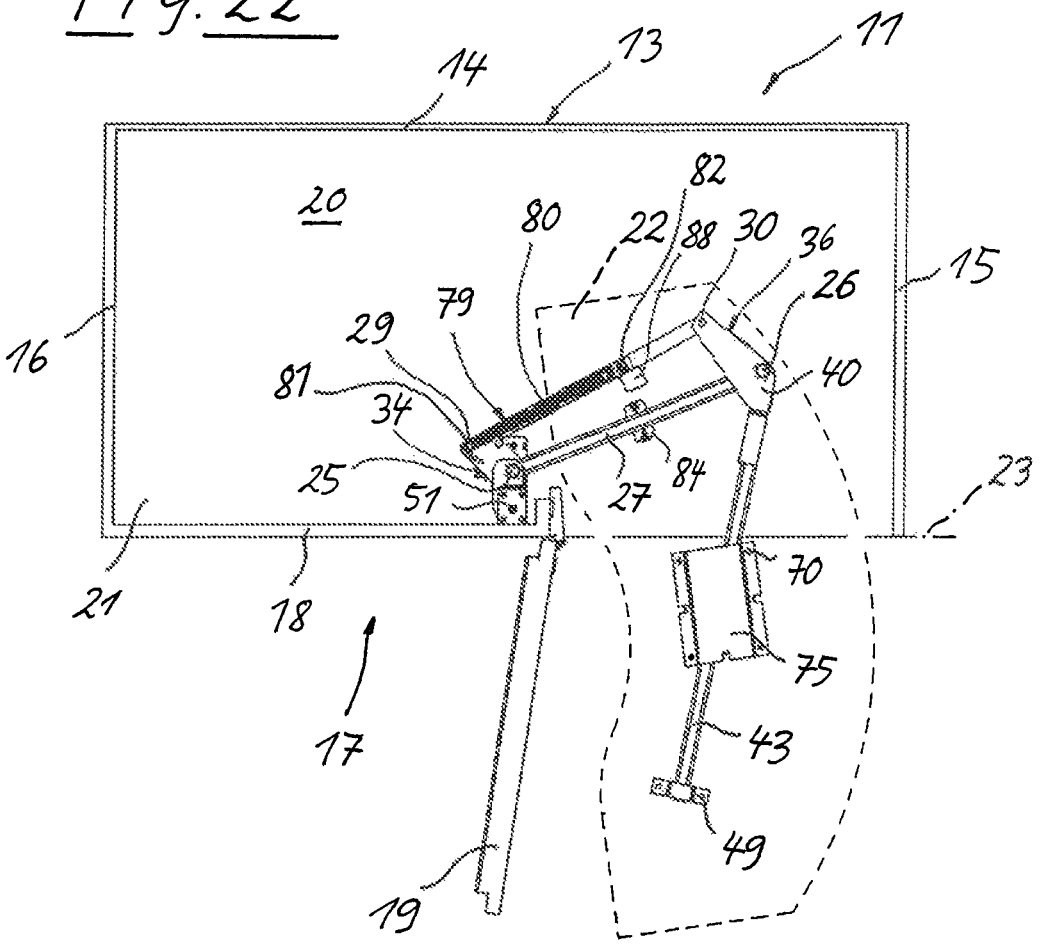
FIG. 22 shows a top view of the fitting according to FIG. 21, with the panel being in an intermediate position.
Figure 23:
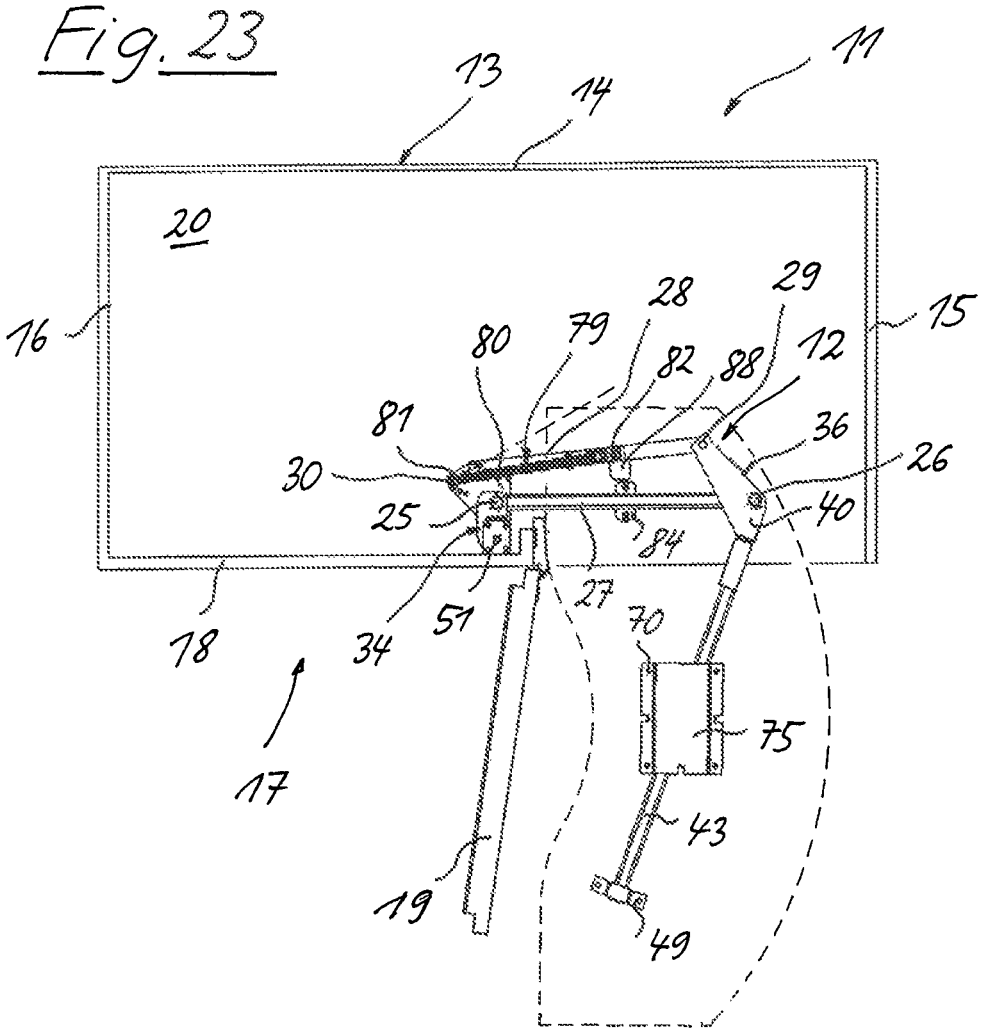
FIG. 23 shows a top view of the fitting according to FIG. 21, with the panel being in its outer position.

When fixing the fitting 12 according to the first embodiment example, the support arm 43 is attached with its mounting lug on the interface group 74*b* oriented in the Y direction to one panel half 48 and is fixed by means of the fixing screws. The axle beam 40 with its bearing pin is attached to the interface group 74*c* oriented in the Y direction on the other panel half and is fixed there. This fastening results in a panel movement as shown in FIGS. 21 to 23. This means that the corner cupboard door 19 is located, if viewed from the front, on the right-hand side and the panel 22 swings out of the corner cupboard 11 in a clockwise direction.

However, by means of the interface pattern 72 according to the first embodiment example it is possible in a simple manner to make the fitting 12, and thus the panel 22, to swing out of the internal space 21 in the opposite direction, i.e. in a counter-clockwise direction. To this end, the corner cupboard door 11 would then be mounted on the left-hand side. To this end, the fitting 12 is folded over by 180° and the mounting lug 49 on the support arm 43 is fixed on the other, opposite sides of the support arm 43. The support arm 43 with its mounting lug 49 then protrudes into the panel half 48, where the axle beam 40 was placed in the other fastening position, whilst the axle beam 40 now protrudes into the panel half 48, where previously the support arm 43 with its mounting lug 49 was positioned. When fixing the fitting 12, the mounting lug 49 is again fixed to the interface group 74*d* oriented in the Y direction, whilst the axle beam 40 is then fixed with the bearing pins on the other panel half 48 to the interface group 74*a* oriented in the X direction.

This means the panel 22 can, depending on the requirements, be swung out of the internal space 21 either towards the right or the left.

Figure 4:
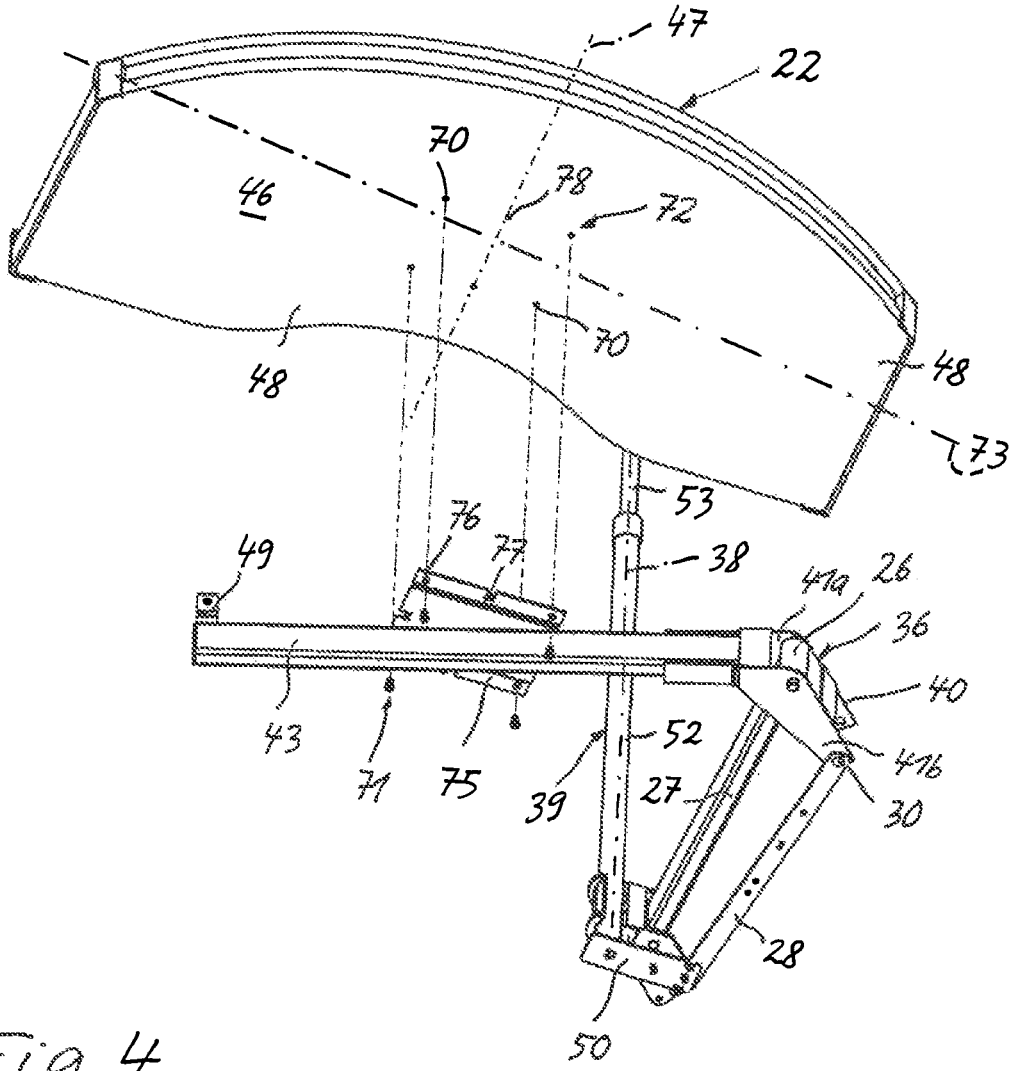
FIG. 4 shows a perspective view of the fitting of FIG. 1 from the bottom, including the fastening interfaces on the bottom surface of the panel.
Figure 5:
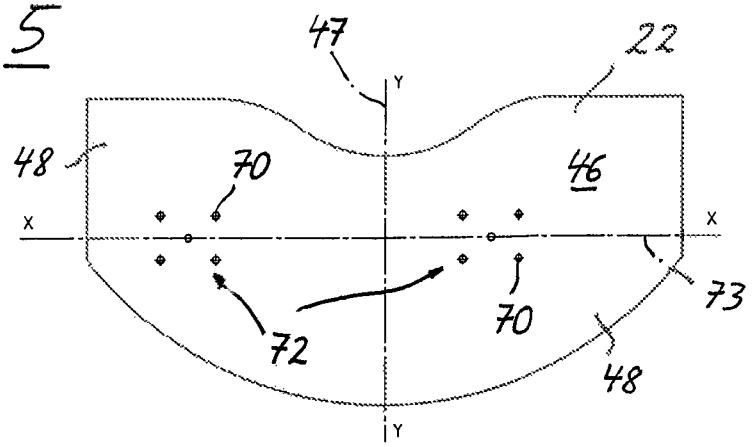
FIG. 5 shows a schematic bottom view of a panel with a further embodiment of an interface pattern on fastening interfaces.

FIGS. 4 and 5 show a second embodiment example of the fitting 12 according to the invention, which differs from the previously described first embodiment example in that the interface pattern 72 is designed differently and also other interface means 71 are used. Here, too, the fastening interfaces 70 are located in all of the four quadrants established by the X and Y axes on the panel bottom surface 46. In contrast to the aforementioned embodiment example, however, in both of the different fixing positions of the fitting 12, all of the fastening interfaces 70 are used here by the associated interface means. As an example, four fastening interfaces 70 are provided here.

The interface means 71 comprise an adapter plate 75 which is detachably fixed to the top surface of the square tube-like support arm 43. The adapter plate 75 has insertion holes 76, for example four, in correspondence with the number of fastening interfaces 70. Fastening elements, for example fastening screws, are passed through the insertion holes 76, which screws are fixed in the corresponding fastening interfaces 70 on the panel bottom surface 46. On the adapter plate 75, centering elements in the form of centering tongues 77 extending upwards beyond the top surface of the adapter plate 75 are expediently located in the longitudinal direction between two insertion holes 76, which centering tongues can be inserted into corresponding centering holes 78 on the panel bottom surface 46, which are expediently also arranged in the X direction between two fastening interfaces 70. By means of the corresponding centering tongues 77 and centering holes 78, the adapter plate may be accurately positioned, so that the alignment between the insertion holes 76 on the adapter plate 75 and the fastening interfaces 70 is automatically achieved.

Also the second embodiment example is suitable for achieving in a simple manner a swinging out of the panel 22 from the internal space 21 in the opposite direction. To this end, the fitting 12 is again folded over by 180° and the adapter plate 75 is fixed on the opposite side of the support arm 43. Contrary to the above-described embodiment example, here all of the fastening interfaces 70 are used again and the adapter plate 75 is attached in the same position on the panel bottom surface 46 as before. This means that here, too, the panel 22 may be swung out, depending on the requirements, either towards the left or towards the right, with the corner cupboard door then being disposed either on the left-hand side or on the right-hand side.

Figure 6:
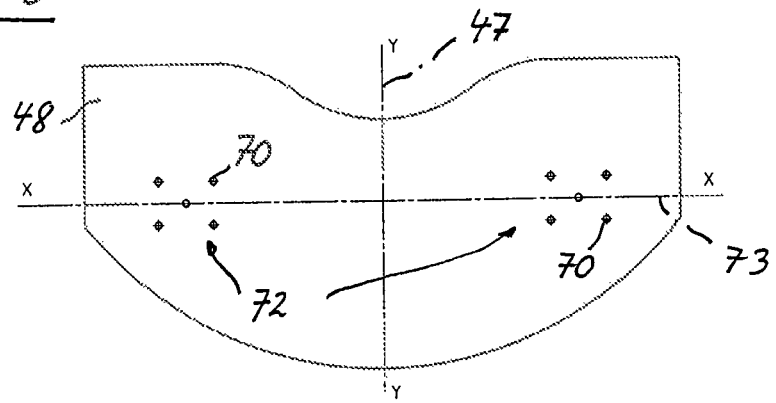
FIG. 6 shows a bottom view of a panel according to FIG. 5 having an interface pattern on fastening interfaces that differs from that in FIG. 5.
Figure 7:
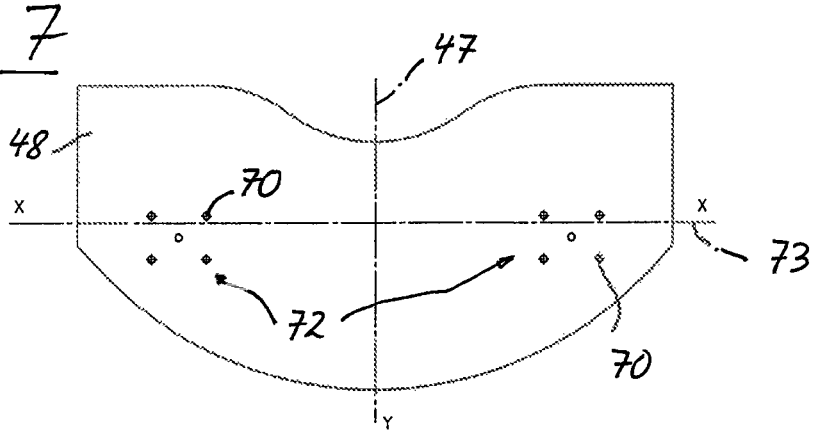
FIG. 7 shows a schematic view of the panel of FIG. 5 having an interface pattern on fastening interfaces that differs from that in FIGS. 5 and 6.

FIGS. 5 to 7 show further embodiments of interface patterns 72, which differ from the interface patterns described before. In the case of the panel shown in FIG. 5, fastening interfaces 70 are arranged on the panel bottom surface, for example ten in number, which are arranged to be mirror symmetrical relative to the X axis.

FIG. 6 shows a variant of the interface pattern 72 of FIG. 5, and here the fastening interfaces 70 are oriented both mirror symmetrically relative to the X axis and mirror symmetrically relative to the Y axis.

FIG. 7, finally, shows a further variant, wherein the fastening interfaces, for example also ten in number, are oriented mirror symmetrically relative to the Y axis.

The fitting 12 further has pull-in and pull-out means 79 for aiding the inward and outward movement of the panel into the inner and outer positions. The pull-in and pull-out means 79 include a spring unit 80 which is supported on the one hand on a stationary spring bearing point 81 and on the other hand on a movable bearing point 82 which moves together with the panel, in such a way that a torque supporting the inward movement in the direction of the inner position, and upon passing a dead centre, a torque supporting the outward movement in the direction of the outer position are applied to the fitting 12. As is shown in particular in FIGS. 21 to 23, the spring unit 18 is formed by a tension spring in the form of a helical tension spring. The stationary spring bearing point 81 is here located on the clamping piece 34, namely on the extended plate-like leg, on which also the stationary swivel pin 29 of the control lever 28 is located. The support position that moves together with the panel is located on the control lever 28, in particular approximately midway between the stationary swivel pin 29 and the panel-fixed bearing axle 30.

The stationary swivel pin and the movable bearing point 82 of the spring on the control lever 28 define a straight line, with respect of which the stationary spring bearing point 81 is located on one side whilst supporting the inward movement, and is located on the other side whilst supporting the outward movement.

According to FIG. 21, the panel is initially located in its inner position in the internal space 21 of the corner cupboard 11. In this inner position, the stationary swivel pin 28 and the stationary spring bearing point 81 are spaced apart, namely on the one side of the straight line formed by the stationary swivel pin of the control lever 28 and the movable bearing point of the spring unit 80. In this inner position, a torque is applied in a counter-clockwise direction on the control lever 28 and thus on the panel 22, so that the panel 22 is held in the inner position as defined by the spring unit 80. If the panel 22 is now swung out of the internal space 21 in a clockwise direction, then this force will first have to be overcome in the inward movement direction, in order to swing the panel 22. When swinging out, the panel 22 will then reach an intermediate position, in which the stationary swivel pin 29 of the control lever 28 and the stationary spring bearing point 81 are located on one line, so that no torque is applied. This is the dead centre. If the panel 22 is now swung out even further from the internal space 21 in a clockwise direction, the stationary bearing point 81 will move to the other side of the straight line formed by the stationary swivel pin 29 and the movable bearing point 82, so that a torque is generated in the outward movement direction, so that the outward movement of the panel is aided by the spring force of the spring unit 80. When moving the panel inwards from the outer position to the inner position, the opposite processes are carried out. To start with, the force of the spring unit 80, which pushes the panel 22 in the direction of the outer position, has to be overcome, until ultimately the dead centre is reached again. Upon passing the dead centre, a torque is applied by the spring unit 80 in the inward movement direction, so that the inward movement of the panel 22 is aided.

Figure 9:
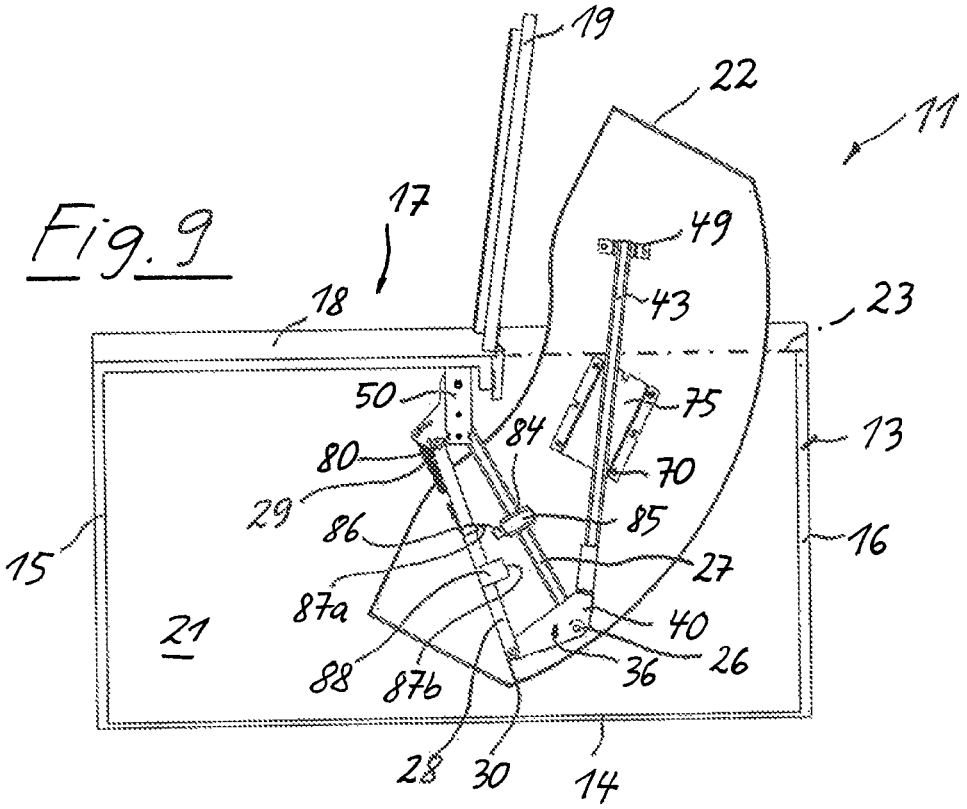
FIG. 9 shows a bottom view of the fitting with the panel of FIG. 8, with the panel being in an intermediate position.
Figure 10:
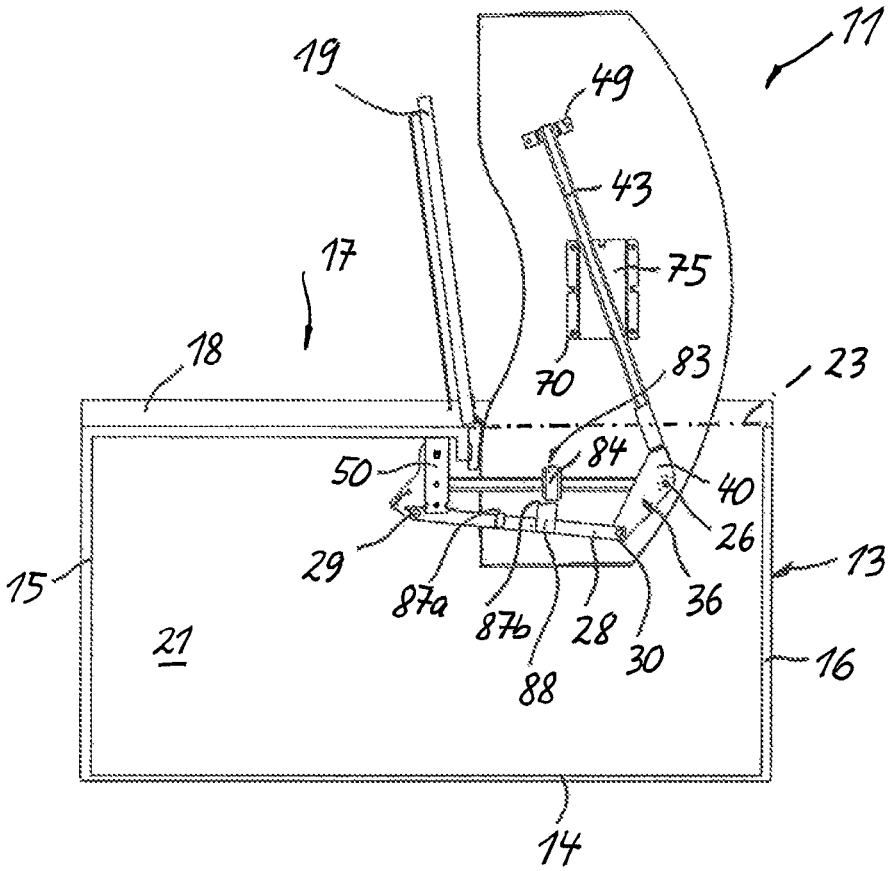
FIG. 10 shows a bottom view of the fitting with the panel according to FIG. 8, with the panel being in the outer position.
Figure 11:
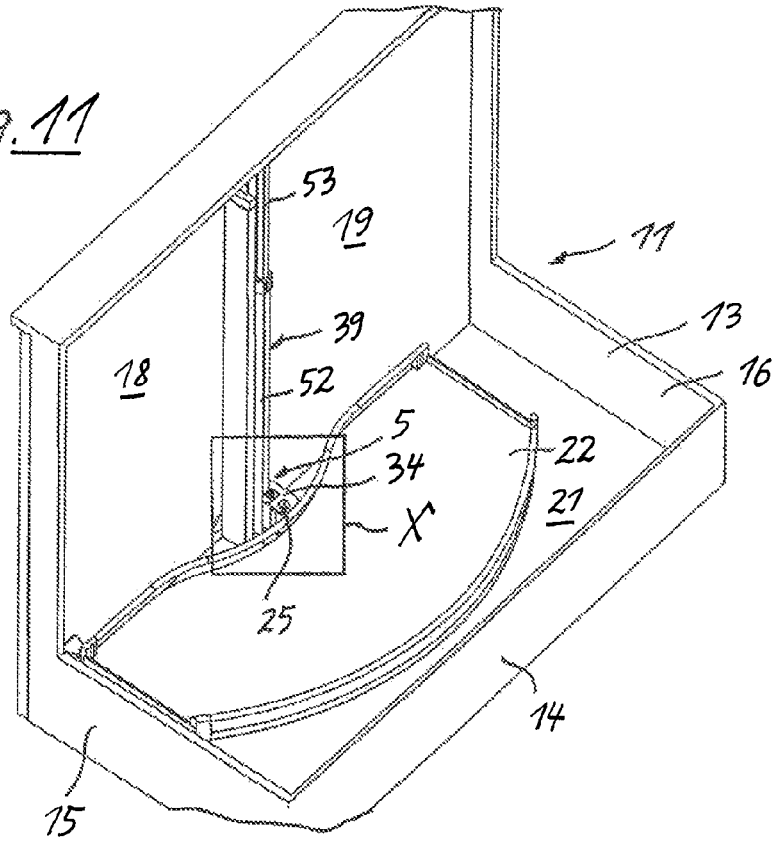
FIG. 11 shows a perspective sectional view of the fitting according to the invention with the panel fixed to the support column in a first height position.
Figure 12:
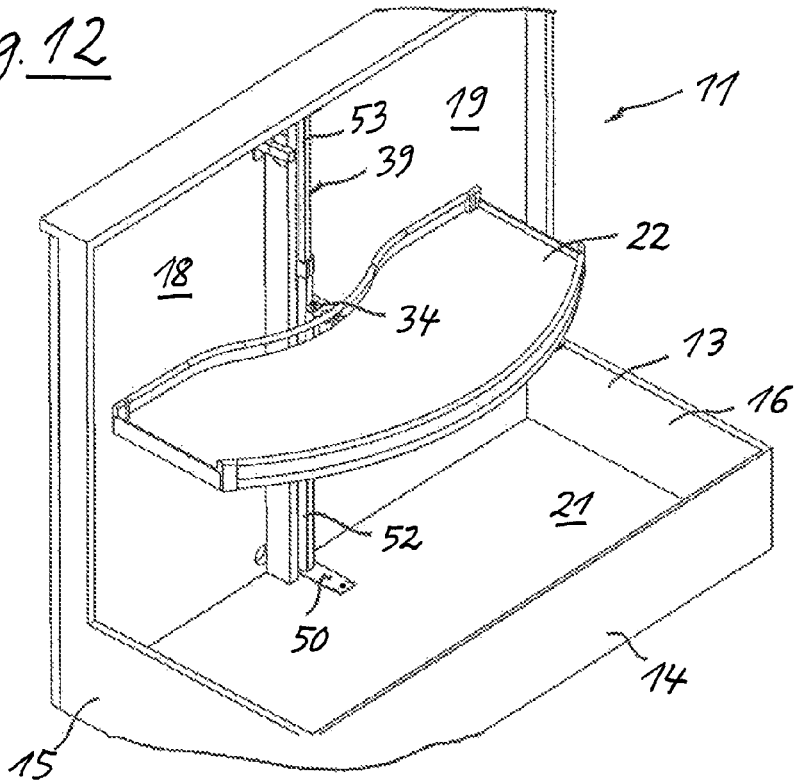
FIG. 12 shows a perspective sectional view of the fitting with the panel of FIG. 11 fixed to the support column in a second height position.
Figure 13:
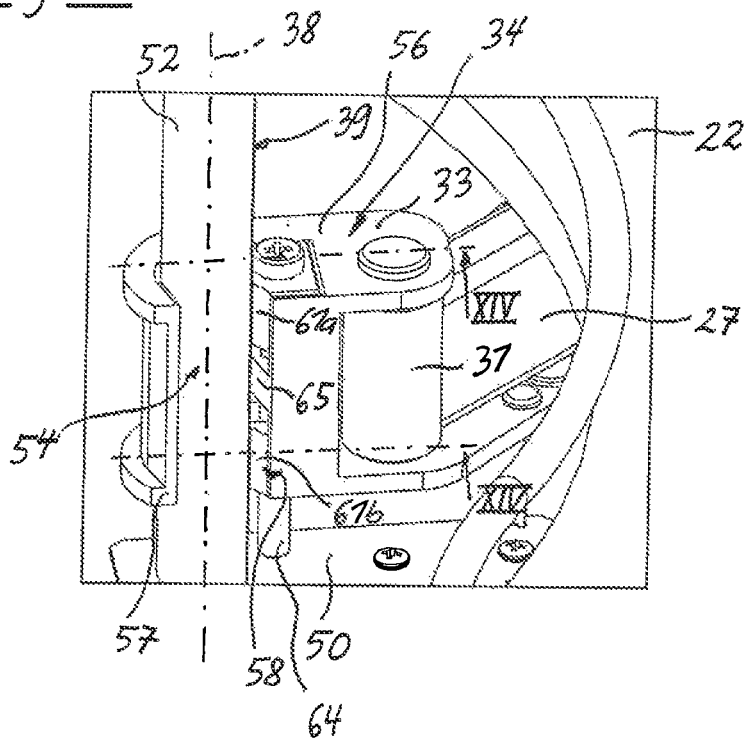
FIG. 13 shows a perspective view of detail X in FIG. 11.

Further, damping means 83 for damping the panel movement when moving into the inner position and/or moving into the outer position are provided. The damping means 83 include a shock absorber 84 arranged in such a way that it damps both whilst approaching the inner position and whilst approaching the outer position and is without effect in at least one intermediate position between the inner and the outer position. The shock absorber 84 is shown in FIGS. 8 to 10 in an exemplary arrangement on the control/support lever 27, where it is located approximately midway between the stationary swivel pin 25 and the panel-fixed swivel axle 26 of the control/support lever 27. The shock absorber 84 is formed by a damping cylinder having a cylinder housing 85, in which a damping piston 86 is guided in a linearly displaceable manner.

On the control lever 28, two stop surfaces 87*a*, 87*b* are arranged in different positions, which stop surfaces cooperate with the damping piston 86 in such a way that during an approach towards the inner position, a damping stop of the shock absorber 84 and one 87*a* of the stop surfaces, and during an approach towards the outer position, a damping stop of the shock absorber 84 and the other 87*b* stop surface are provided. This means that one and the same shock absorber 84 damps both during an approach towards the inner position and during an approach towards the outer position. The two limit positions of the panel 22, i.e. the inner and the outer positions, are damped.

Since the panel-fixed bearing axles 26, 30 of the control/support lever 27 and of the control lever 28 run along circular paths having different diameters, there will be a relative movement of the control/support lever 27 and the control lever 28. On account of this fact, the two stop surfaces 87*a*, 87*b* located in different positions are provided. One of these stop surfaces is located on a face side of a stop member 88 fixed to the control lever 28, and this stop surface 87*b* is located, with regard to a longitudinal axis through the control lever, radially further outwards than the other stop surface 87*a*.

Thus, the fitting 12 and the panel 22 are initially located in the inner position shown in FIG. 8 in the internal space 21 of the corner cupboard 11. Here, the stop surface 87*a*, which is formed by the outer contour of the control lever 28, pushes against the damping piston 86 of the shock absorber 84. If the panel is then, for example as shown in FIG. 9, swung out of the corner cupboard in a clockwise direction, the control/support lever 27 and the control lever 28 move relative to one another, so that the damping piston 86 moves out of contact with the stop surface 87*a*, as a result of which the shock absorber 84 is without effect. If the panel is now moved further towards the outer position, the damping piston 86 will, during the approach towards this outer position, come into contact with the other stop surface 87*b* formed on the stop member 88, so that the movement into the outer position is damped. When moving into the inner position, the processes occur the other way round. The damping piston 86 will initially come away from the stop surface 87*b*, so that the shock absorber 84 is without effect. When approaching the inner position, the damping piston 86 comes into contact with the stop surface 87*a*, so that the movement into the inner position is damped.

The invention claimed is:

1. A fitting for a corner cupboard comprising a cupboard body and an internal space accessible via a corner cupboard door, wherein at least one panel is movably guided by means of the fitting between an inner position and an outer position, in which the at least one panel at least partially extends beyond a level of a door opening, said fitting comprising:

a support column mountable within the corner cupboard;

a control/support lever for supporting the at least one panel, said control/support lever being a metal tube mounted at one end to said support column so as to be pivotable about a stationary swivel pin and being mounted at an opposite end on the at least one panel in a manner so as to be pivotable about a panel-fixed bearing axle, said control/support lever being part of a control means for controlling the panel movement in a swivel plane between the inner and the outer positions;

a control lever mounted at one end to said support column about a stationary swivel pin and being mounted at an opposite end on the at least one panel in a manner so as to be pivotable about a panel-fixed bearing axle, with said two stationary swivel pins being arranged next to each other or coinciding adjacent said support column; and a connecting link connecting said opposite ends of said control/support lever and said control lever, said connecting link receiving the panel-fixed bearing axles of the control levers, said connecting link being fixed to the at least one panel, wherein the control/support lever has a greater bending stiffness at a right angle to the swivel plane than the control lever, and wherein the connecting link has an axle beam receiving the two panel-fixed bearing axles and a support arm which is rigidly connected to the axle beam and which supports the at least one panel besides the control/support lever, and wherein the two panel-fixed bearing axles are positioned on the axle beam on a connecting line extending at an obtuse angle relative to a longitudinal axis of the support arm.

2. The fitting as defined in claim 1, wherein the control/support lever and the control lever are respectively formed as individual levers of constant lengths between the stationary swivel pins and panel-fixed bearing axles.

3. The fitting as defined in claim 1, wherein the control/support lever and the control lever are respectively supported with their stationary swivel pin on a bearing element, the bearing element being fixed to the support column of the corner cupboard.

4. The fitting as defined in claim 3, wherein the stationary swivel pin of the control/support lever and the stationary swivel pin of the control lever are spaced apart from each other on the bearing element, with the stationary swivel pin of the control/support lever being located closer to a longitudinal axis of the support column than the stationary swivel pin of the control lever.

5. The fitting as defined in claim 1, wherein the control/support lever and the control lever have different lever lengths.

6. The fitting as defined in claim 5, wherein the control/support lever has a greater lever length than the control lever.

7. The fitting as defined in claim 1, wherein a central transverse axis of the at least one panel, which the axis divides the at least one panel into two panel halves, and the panel-fixed bearing axles received by the connecting link are located in one panel half in relation to the central transverse axis.

8. The fitting as defined in claim 7, wherein the support arm extends into another panel half and has fastening means for fixing it to the at least one panel.

9. The fitting as defined in claim 1, wherein the control/support lever is a square metal tube.

10. The fitting as defined in claim 1, wherein the control lever is formed from a flat iron bar.

11. The fitting as defined in claim 1, wherein the support arm is formed from a square metal tube.

12. The fitting as defined in claim 1, wherein the axle beam has a plate-like first axle journal and a plate-like second axle journal extending parallel thereto, which are spaced apart by at least one spacer and which receive between them the panel-fixed bearing axle of the control/support lever.

* * * * *